US006017183A

United States Patent [19]

Dobler et al.

[11] Patent Number: 6,017,183

[45] Date of Patent: Jan. 25, 2000

[54] FLOW PUMP

[75] Inventors: Klaus Dobler; Michael Huebel, both of Gerlingen; Willi Strohl, Beilstein; Jochen Rose, Hemmingen, all of Germany

[73] Assignee: Robert Bosch GmbH, Stuttgart, Germany

[21] Appl. No.: 08/983,595

[22] PCT Filed: Apr. 15, 1997

[86] PCT No.: PCT/DE97/00760

§ 371 Date: Dec. 31, 1997

§ 102(e) Date: Dec. 31, 1997

[87] PCT Pub. No.: WO98/09081

PCT Pub. Date: Mar. 5, 1998

[30] Foreign Application Priority Data

Aug. 29, 1996 [DE] Germany ..... 196 34 900

[51] Int. Cl.[7] ..... F01D 1/12

[52] U.S. Cl. ..... 415/55.1; 415/55.2; 415/55.3; 415/55.4; 415/55.6; 415/55.7; 415/119

[58] Field of Search ..... 415/55.1, 55.2, 415/55.3, 55.4, 55.6, 55.7, 119

[56] References Cited

U.S. PATENT DOCUMENTS

| | | | |
|---|---|---|---|
| 5,391,062 | 2/1995 | Yoshioka | 417/423.3 |
| 5,429,476 | 7/1995 | Krauter et al. | 415/55.1 |
| 5,449,269 | 9/1995 | Frank et al. | 415/55.1 |
| 5,498,124 | 3/1996 | Ito et al. | 415/55.1 |
| 5,558,490 | 9/1996 | Dobler et al. | 415/55.1 |
| 5,716,191 | 2/1998 | Ito et al. | 415/55.4 |

FOREIGN PATENT DOCUMENTS 40 20 521A1 1/1992 Germany .

*Primary Examiner*—Edward K. Look
*Assistant Examiner*—Matthew T. Shanley
*Attorney, Agent, or Firm*—Michael J. Striker

[57] ABSTRACT

In connection with a flow pump, particularly for the conveying of fuel from a fuel tank of a motor vehicle, with a pump chamber embodied in a pump housing which is bordered by two radially extending lateral walls (12), spaced apart from each other, and a peripheral wall, connecting the lateral walls (12) along their periphery with each other, with at least one groove like lateral channel (20) disposed in one of the lateral walls (12), open toward the pump chamber, which extends, related to the flow direction in the lateral channel (200, concentrically in relation to the pump axis (22), with an interrupting strip (35), remaining between a lateral channel end (202) and a lateral channel start (201), and having a rotating impeller wheel disposed in the pump chamber, a damping groove (36), open in the direction toward the pump chamber, has been cut into the interrupting strip (35) near the lateral channel end (202), which approximately extends over the width of the lateral channel, for reducing the locally very high pressure amplitudes of the impeller frequency vibration (FIG. 5).

12 Claims, 3 Drawing Sheets

FLOW PUMP

This application has been filed under 35 U.S.C. 371 and claims foreign priority benefits under 35 U.S.C. 119 of PCT/DE97/00760, filed Apr. 15, 1997, which is based upon German patent application Serial#: 19634900.1, filed AUG. 29, 1996.

BACKGROUND OF THE INVENTION

The invention relates to a flow pump particularly for the conveying of fuel from the fuel tank of a motor vehicle.

In a known dual-flow pump of this species (DE 40 20 521 A1), called peripheral pump there, of the walls delimiting the pump chamber, one lateral wall and the peripheral wall are embodied on an intermediate housing having the pump outlet, and the other side wall is embodied on a housing cover of a pump inlet having the output connector. The pump or impeller wheel disposed in the pump chamber is fitted on top of a housing cover which has an extruded journal and is connected, fixed against relative rotation, with the power-take off shaft of an electric motor that is housed in a mounting support embodied in a intermediate housing. During operation the flow pump aspirates the fuel through the aspirating connector and pushes the same through the pump outlet into the inner chamber of a pump housing enclosing an electric motor and the intermediate housing. From there the compressed fuel is fed into the internal combustion engine by means of a pressure line which can be connected to a pressure connector of the pump housing.

This known flow pump demonstrates a good noise behavior as a result of the geometric shape outlet area of the lateral channel in the two lateral walls.

SUMMARY OF THE INVENTION

It is therefore an object of the present invention to provide a flow pump which is a further improvement of existing flow pumps.

In keeping with these objects and with others which will become apparent hereinafter, one feature of present invention resides, briefly stated, in a flow pump which is a further improvement of the existing flow pumps.

In keeping with these objects and with others which will become apparent hereinafter, one feature of present invention resides, briefly stated, in a flow pump which has a damping groove open in direction toward a pump chamber and formed so that the damping groove is separated from the lateral channel by an interrupting strip and has a contour corresponding to a contour of the lateral channel. When the flow pump is designed in accordance with the present invention, it has the advantage, that the flow-induced noises still caused by the flow pump are greatly reduced. By means of the damping groove of the invention which, in accordance with the invention is located in the area of the highest occurring amplitudes of the wall compression oscillations at the impeller wheel vane frequency, the alternating wall pressures are measurably reduced, which is accompanied by a significant noise reduction. In addition, the advantage presents itself, that bigger axial gaps between the impeller wheel and the lateral walls opposite the front ends of the impeller wheel can be permitted, leading to a higher permitted production tolerances and thus to a reduction of production costs.

BRIEF DESCRIPTION OF THE DRAWINGS

The invention will be explained in more detail in the following description by means of an embodiment represented in the drawings. Shown are in.

DESCRIPTION OF THE PREFERRED EMBODIMENTS

Figure 1:
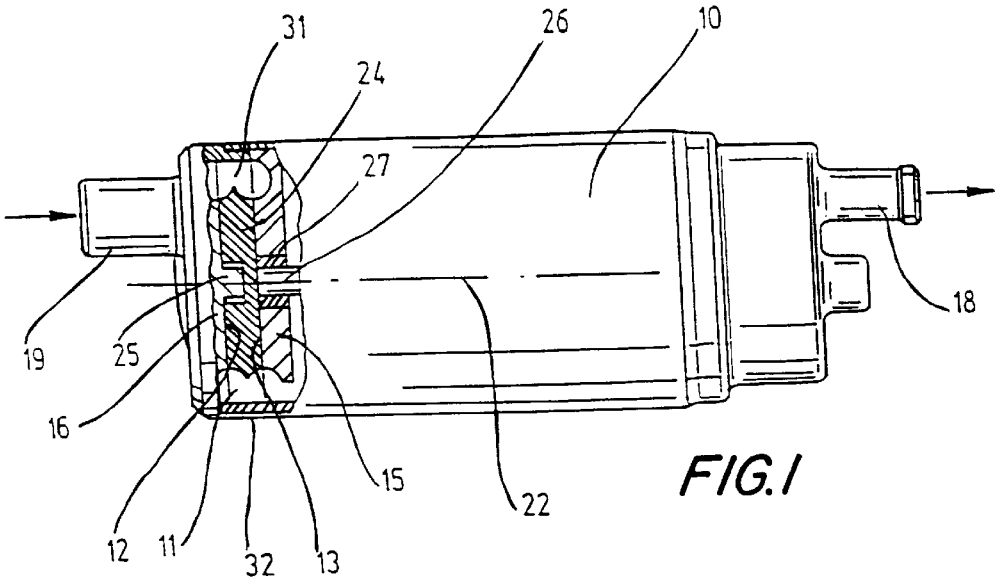
FIG. 1, a lateral view of the flow pump for conveying fuel, partially in section, FIG. 2, a section along the line II—II in FIG. 3 of an intermediate housing in the flow pump in FIG. 1, FIG. 3, a plan view of the intermediate housing in the direction of the arrow III in FIG. 2, FIG. 4, a section along the line IV—IV in FIG. 5 of a housing cover of the flow pump in FIG. 1, FIG. 5, a plan view of the housing cover in the direction of the arrow V in FIG. 4, FIG. 6, a section along the line VI—VI in FIG. 5, FIG. 7, a lateral view of an impeller wheel of the flow pump in FIG. 1.
Figure 2:
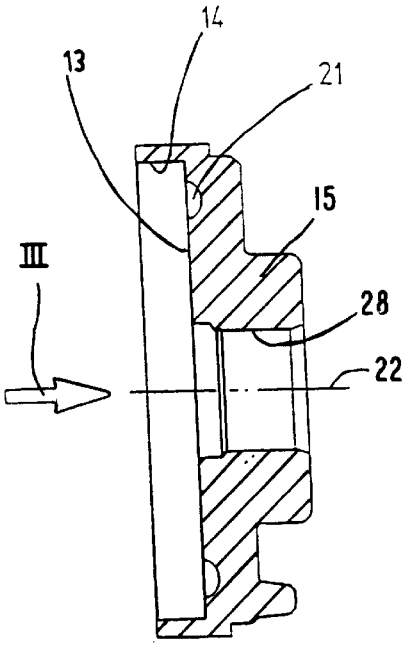
Figure 4:
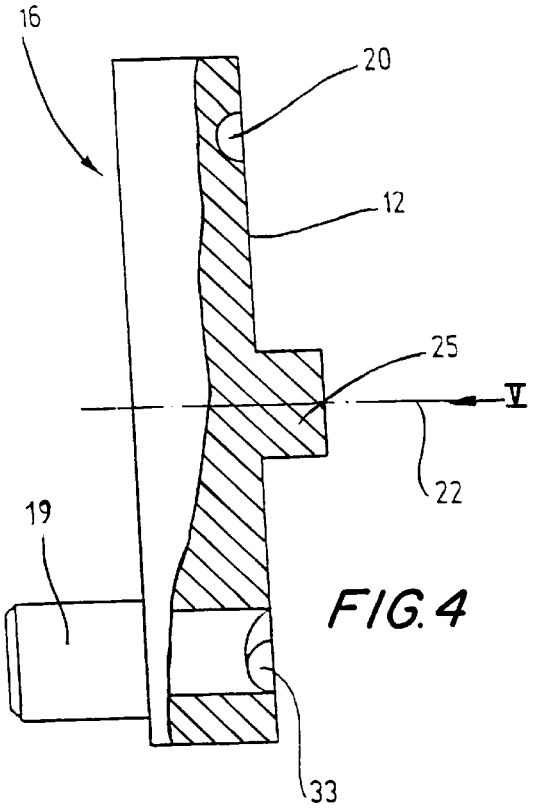
Figure 5:
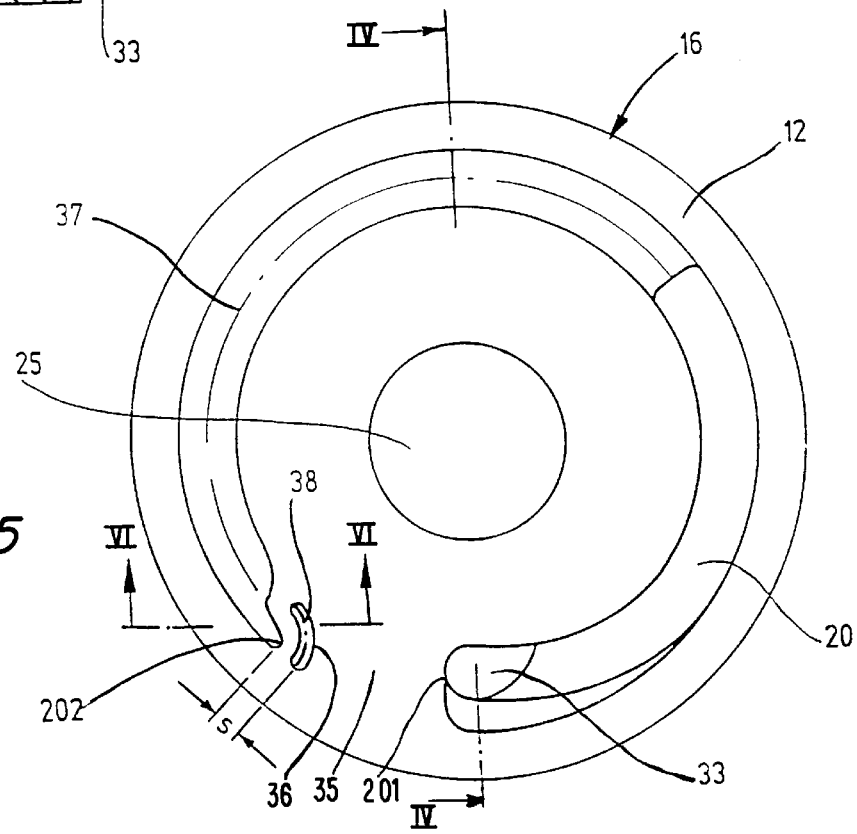

The flow pump shown in lateral view in FIG. 1, also known as side-channel pump, is used for conveying fuel out of a fuel tank, not shown here, of a motor vehicle to an internal combustion engine, also not shown here, of a motor vehicle. The flow pump has a pump chamber 11 embodied in a pump housing 10, which is delimited by two radially extending, axially spaced apart lateral walls 12, 13, and a peripheral wall 14 connecting the lateral walls along their periphery (FIGS. 1 and 2). The lateral wall 13 and the peripheral wall 14 are embodied on an intermediate housing 15 (FIGS. 2 and 3), while the lateral wall 12 is embodied on an aspirating or housing cover 16 (FIG. 4 and 5), which is firmly connected with the intermediate housing 15 and/or the pump housing 10. The pump housing 10 overlaps the intermediate housing 15 and receives an electric motor, which is not visible here, in its interior. In the intermediate housing 15 a pump outlet 17 axially penetrating the lateral wall 13 is further provided, which makes a connection between the pump chamber 11 and the interior of the pump housing 10, and the pump housing 10 is connected with a pressure connector 18, from which the fuel conveyed from the flow pump exits. The housing cover 16 has a aspirating connector 19 to aspirate the fuel from the fuel tank, which is connected with the pump inlet 33 penetrating one of the lateral walls 12 (FIG. 5).

Figure 3:
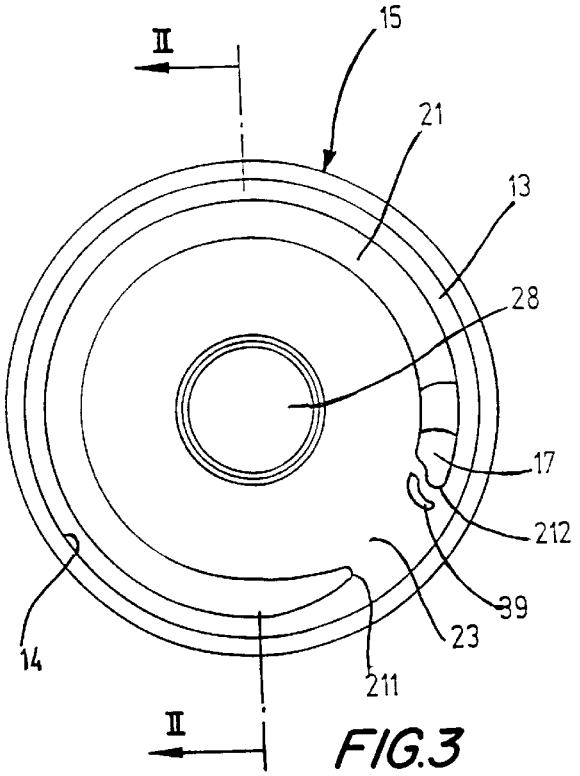

A lateral channel 20, or respectively 21, is embodied in each lateral wall 12, 13 of the flow pump, here embodied as a double-flow pump. As shown in FIGS. 4 and 2, each groove-like lateral channel 20, 21 shows an approximately semicircular-shaped cross section and is open toward the pump chamber 11. Each lateral channel 20,21 extends concentrically in relation to the axis of the pump 22 and extends across almost the entire circumference of the lateral walls 12, or respectively 13, leaving a remaining interrupting strip 35, or respectively 23. The interrupting strip 35 is bounded by the start 201 of the lateral channel and the end 202 of the lateral channel (FIG. 5) and, the interrupting strip 23 is respectively bounded by the start of the lateral channel 211 and the end of the lateral channel 212 (FIG. 3). The start 201 of the lateral channel 20 in the lateral wall 12 at the housing cover 16 is connected with the pump inlet 33 (and the latter in turn with the aspirating connector 19), and the end 212 of the lateral channel 21 embodied in the lateral wall 13 at the intermediate housing 15 is connected to the pump outlet 17 and the latter in turn with the pressure connector 18 via the interior of the pump housing 10.

Figure 7:
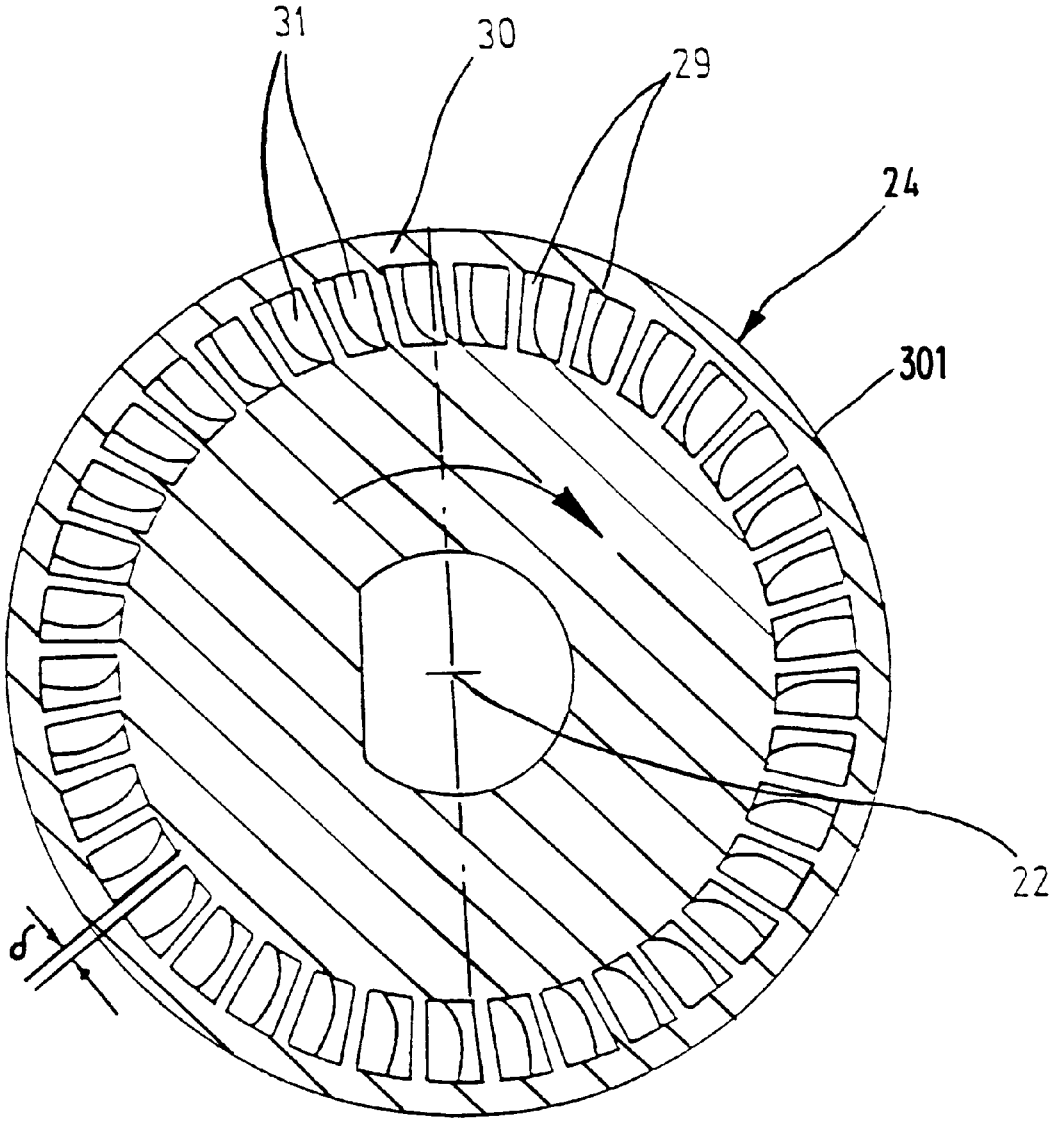

A pump or impeller wheel 24 is disposed coaxially to the pump axis 22 in the pump chamber 11. The impeller wheel 24 is seated on one side on a journal 25 extending coaxially from the lateral wall 12 into the pump chamber 11, and on the other side is seated, fixed against relative rotation, on a power take-off shaft 26 of the electric motor, which is positioned in a positioning sleeve 27 coaxially in relation to the pump axis 22. The positioning sleeve 27 is pressed into a coaxial bore 28 extending through the lateral wall 13 in the intermediate housing 15. The impeller wheel 24 (FIG. 7) consists of a plurality of impeller wheel vanes 29 spaced apart from each other in the circumferential direction, which are connected with each other at their ends facing away from the pump axis 22 by means of a circular outer ring 30. Between each other, the impeller wheel vanes 29 each delimit vane chamber 31, which is open in the direction of the axis. The impeller wheel vanes 29 and the outer ring 30 are embodied with the impeller wheel 24 as one piece, and the impeller wheel vanes 29 are embodied in that strips remain as impeller wheel vanes 29 in the impeller wheel 24 between cutouts disposed on a common distributing circle of the impeller wheel 24. The outer ring 30 is of such dimensions, that a radial gap 32 remains between the circumferential outer surface 301 of the outer ring 30 and the peripheral wall 14 (FIG. 1). During operation the flow pump aspirates fuel through the aspirating connector 19 and pushes the fuel by way of the pump outlet 17 into the interior of the pump housing 10, and from there by way of the pressure connector 18 to the internal combustion engine.

In order to significantly reduce the locally very high pressure amplitudes of the frequency vibration of the vanes and thus to reduce the noise level of the flow pump significantly, a curved damping groove 36, open toward the pump chamber 11, has been cut into the lateral channel 20 in the lateral wall 12 at the input or housing cover 16 has an (FIG. 5), which extends approximately over the width of the lateral channel. The end of the lateral channel 20, marked as 202 in FIG. 5, has an approximately S-shaped curved contour, wherein the center portion of the contour lies on the center line 37 of the lateral channel 20, or parallel to it. The damping groove 36 now is conducted along the contour of the lateral channel end 202 in such a way, that the distance s, measured in the circumferential direction, between the center line 38 of the damping groove 36 and the contour of the lateral channel end 202 is constant at each point along the center line 38. In this case, the distance s is made one to three times as large as the thickness δ of the impeller wheel vanes 29, viewed in the circumferential direction of the impeller wheel 24. The shape of the damping groove 36 is made such, that the outer and inner circular-shaped boundary line of the damping groove 36 and the center line 38 of the damping groove 36 have the same center of curvature.

Figure 6:
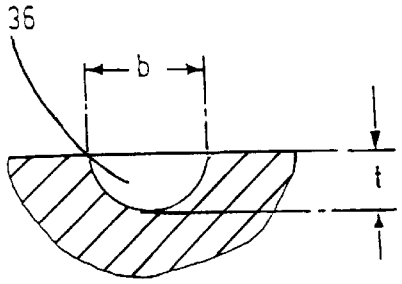

As shown in the sectional drawings in FIG. 6, the damping groove 36 has a semicircular cross section, wherein the maximal groove depth t lies in the range of 0.1–1.5 mm, preferably between 0.2 mm and 0.5 mm. The maximal groove width b is two to three times the thickness δ of the impeller wheel vanes 29 of the impeller wheel 24, viewed in the longitudinal direction.

As shown in FIG. 3, in addition to the damping groove 36 in the lateral wall 12 of the housing cover 16, a second damping groove 39, embodied in the same way, can be cut into the lateral wall 13 of the intermediate housing 15, here again in the interrupting strip 23 near the lateral channel end 212 of the lateral channel 21. As already mentioned, the pump outlet 17 terminates here. The damping groove 39 is embodied identically to the damping groove 36, so that the measurements provided there also apply here.

In an alternative embodiment of the flow pump, the damping groove 36 in the lateral wall 12 of the housing cover 16 can be omitted, so that—as previously described—only the damping groove 36 exists in the lateral wall 13 of the intermediate housing 15.

The invention is not limited to the described exemplary embodiments. Thus the flow pump can also be embodied as a single flow model, so that only one lateral channel exists in one lateral wall, whose lateral channel start is connected with the pump inlet and whose lateral channel end with the pump outlet. In this case, the lateral channel can be embodied in the intermediate housing or in the housing cover.

We claim:

1. A flow pump, particularly for the conveying of fuel from a fuel tank of a motor vehicle, with a pump chamber (11) embodied in a pump housing (10) which is bordered by two radially extending lateral walls (20, 21), spaced apart from each other, and a peripheral wall (14), connecting the lateral walls (20, 21) along their periphery with each other, with at least one groove-like lateral channel (20, 21) disposed in one of the lateral walls (12,13), open toward the pump chamber (11), which extends, related to the flow direction in the lateral channel (20, 21), concentrically in relation to the pump axis (22), with an interrupting strip (35, 23), remaining between a lateral channel end (202, 212) and a lateral channel start (201, 211), and having a rotating impeller wheel (24) disposed coaxially with the pump axis (22) in the pump chamber (11), which has a plurality of radial impeller wheel vanes (29) circumferentially spaced apart from each other in the circumferential direction, which between themselves define radial chambers (31) at least axially open, a damping groove (36) open in the direction toward the pump chamber (11), has been provided near the lateral end (202) and approximately extends over the width of the lateral channel, and the damping groove (36) is separated from the lateral channel (20, 21) by an interrupting strip (35) and has a curved contour corresponding to a contour of the lateral channel end (202).

2. The pump in accordance with claim 1, wherein the damping groove (36) has a semicircular cross section.

3. The pump in accordance with claim 1 wherein the maximal groove (t) of the damping groove (36) lies in the range of 0.1–1.5 mm.

4. The pump in accordance with claim 1, wherein the maximal groove width (b) of the damping groove (36) is one to three times the thickness (δ) of the impeller wheel vanes (29) of the impeller wheel (24), viewed in the circumferential.

5. The pump in accordance with claim 1, wherein a lateral channel (20, 21) is provided in each lateral wall (12, 13), and the lateral channel start (201) of the one lateral channel (20) is connected with a pump inlet (33), and the lateral channel end (212) of the other lateral channel (21) with the pump outlet (17), and that the damping groove (36) is disposed in the interrupting strip (35) of that lateral channel (20), whose lateral channel start (201) is connected with the pump inlet (33).

6. The pump in accordance with claim 1, wherein a lateral channel (20, 21) is provided in each lateral wall (12, 13), and the lateral channel start (201) of the one lateral channel (20) is connected with a pump inlet (33), and the lateral channel end (212) of the other lateral channel (21) is connected with a pump outlet (17), and that the damping groove (39) is disposed in the interrupting strip (23) of that lateral channel (21), whose lateral channel end 212) is connected with the pump outlet (17).

7. The pump in accordance with claim 1, wherein a lateral channel (20, 21) is provided in each lateral wall (12, 13), and the lateral channel start (201) of the one lateral channel (20)

is connected with a pump inlet (33), and the lateral channel end (212) of the other lateral channel (21) is connected with a pump outlet (17), and that damping grooves (36, 39) of the same kind are disposed in the interrupting strip (35, 23) of each lateral channel (20, 21).

8. The pump in accordance with claim 1, wherein the one lateral wall (13) and the peripheral wall (14) are embodied in an intermediate housing (15) containing the pump outlet (17), and the other lateral wall (12) is embodied on a housing cover (16) containing the pump inlet (33), which is fixedly connected with the intermediate housing (15) and/or the pump housing (10).

9. The pump in accordance with claim 1, wherein the maximum groove depth (t) of the damping groove (36) lies in the range of 0.2–0.5 mm.

10. A flow pump, particularly for the conveying of fuel from a fuel tank of a motor vehicle, with a pump chamber (11) embodied in a pump housing (10) which is bordered by two radially extending lateral walls (20, 21), spaced apart from each other, and a peripheral wall (14), connecting the lateral walls (20, 21) along their periphery with each other, with at least one groove-like lateral channel (20, 21) disposed in one of the lateral walls (12, 13), open toward the pump chamber (11), which extends, related to the flow direction in the lateral channel (20, 21), concentrically in relation to the pump axis (22), with an interrupting strip (35, 23), remaining between a lateral channel end (202, 212) and a lateral channel start (201, 211), and having a rotating impeller wheel (24) disposed coaxially with the pump axis (22) in the pump chamber (11), which has a plurality of radial impeller wheel vanes (29) circumferentially spaced apart from each other in the circumferential direction, which between themselves define radial chambers (31) at least axially open, a damping groove (36) open in the direction toward the pump chamber (11), has been cut into the interrupting strip 35) near the lateral end (202) and approximately extends over the width of the lateral channel, the damping groove (36) is conducted along the contour of the lateral channel end (202) in such a way, that the distance (s), measured in the circumferential direction between the center line (38) of the damping groove (36) and the contour of the lateral channel end (202) remains constant at each point of the center line (38).

11. The pump in accordance with claim 10, wherein the boundary lines of the damping groove (36), located on both sides of the center line (38), and the center line (38) have the same center point of curvature.

12. The pump in accordance with claim 11, wherein the distance (s) is one to three times the size of the thickness (δ) of the impeller wheel vanes (29), viewed in the circumferential direction of the impeller wheel (24).

* * * * *